US005230124A

United States Patent [19]

Booth

[11] Patent Number: 5,230,124

[45] Date of Patent: Jul. 27, 1993

[54] ROLLER WITH CLOTHING RETAINING STRUCTURE AND CARD CLOTHING

[75] Inventor: Graham R. Booth, Huddersfield, England

[73] Assignee: James Holdsworth & Brothers Limited, Mirfield, United Kingdom

[21] Appl. No.: 775,922

[22] PCT Filed: Apr. 5, 1990

[86] PCT No.: PCT/GB90/00508

§ 371 Date: Oct. 23, 1991

§ 102(e) Date: Oct. 23, 1991

[87] PCT Pub. No.: WO90/12136

PCT Pub. Date: Oct. 18, 1990

[30] Foreign Application Priority Data

Apr. 8, 1989 [GB] United Kingdom ..... 8907969

[51] Int. Cl.[5] ..... D01G 15/14

[52] U.S. Cl. ..... 19/112; 19/114; 492/48; 492/22

[58] Field of Search ..... 19/54, 97, 106 R, 110, 19/112, 113, 114; 29/110, 118, 121.1, 121.3, 121.6, 129, 131; 57/408; 66/9 B; 101/415.1

[56] References Cited

U.S. PATENT DOCUMENTS

| | | | |
|---|---|---|---|
| 761,470 | 5/1904 | Gessner | 19/112 |
| 1,084,786 | 1/1914 | Calderwood | 19/112 |
| 1,731,534 | 10/1929 | Karrer | 19/54 |
| 2,002,079 | 5/1935 | Dickie | 19/114 |
| 2,437,050 | 3/1948 | Schulz | 29/118 |
| 2,489,791 | 11/1949 | Liles et al. | 29/118 |
| 2,775,199 | 12/1956 | Claff et al. | 29/118 X |
| 3,234,694 | 2/1966 | Vosburg | 29/118 X |
| 3,290,729 | 12/1966 | Maynard | 19/114 |
| 3,947,922 | 4/1976 | Ibbotson | 19/114 |
| 4,356,598 | 11/1982 | Graf | 19/114 |
| 4,408,371 | 10/1983 | Quay | 19/114 |
| 4,516,292 | 5/1985 | Quay | 19/114 X |
| 4,679,390 | 7/1987 | Stewart | 19/112 X |

FOREIGN PATENT DOCUMENTS

| | | | |
|---|---|---|---|
| 0268417 | 5/1988 | European Pat. Off. . | |
| 0395909 | 11/1990 | European Pat. Off. | 19/114 |
| 572689 | 3/1933 | Fed. Rep. of Germany . | |
| 3133280 | 3/1983 | Fed. Rep. of Germany . | |
| 3407392 | 4/1985 | Fed. Rep. of Germany . | |
| 1067137 | 6/1954 | France | 19/114 |
| 0546938 | 1/1979 | Japan | 19/114 |
| 0112033 | 6/1984 | Japan | 19/114 |
| 2114608 | 8/1983 | United Kingdom . | |

*Primary Examiner*—Clifford D. Crowder
*Assistant Examiner*—Ismael Izaguirre
*Attorney, Agent, or Firm*—Merchant & Gould, Smith, Edell, Welter & Schmidt

[57] ABSTRACT

There is disclosed an elongate piece of card clothing (10) which is rectangular as seen in plan, and which is capable of being wrapped around a carrier roll (11) having a slot (12) in its outer periphery with the free ends (18) of the card clothing (10) being received by said slot. The card clothing (10) comprises an elongate strip of resilient material (14) having opposed ends (15) which abut one another in the region of the slot (12), wire carding teeth (16) carried by the strip of resilient material (14), and an elongate carrier web (17, 17*a*) secured to the elongate strip of resilient material (14) and having opposed ends (18) which each project longitudinally beyond a respective end (15) of the strip (14) so as to form a gripping portion which is taken inwardly through the slot (12) to be engaged by gripping means (19) which apply tension to the web (**17, 17*a*) in order to secure the piece of card clothing in position on the outer periphery of the roll (11**).

8 Claims, 5 Drawing Sheets

ROLLER WITH CLOTHING RETAINING STRUCTURE AND CARD CLOTHING

This invention relates to card clothing for application to a carrier cylinder or roll e.g. a doffer roll which forms part of a high pile fabric knitting machine.

High pile fabric knitting machines usually comprise rotary knitting machines provided with a plurality of carding heads, constituting fibre transfer and feeding units, for supplying carded sliver fibres to the knitting needle. Usually, the knitting needles are mounted independently in a cylinder, which is rotatable relative to the several carding heads disposed at circumferentially spaced locations around the cylinder.

The carding heads for feeding carded sliver fibres to the needles of high pile fabric knitting machines are constituted of at least one pair of rotatable sliver feed rolls—usually having either wire-covered or fluted peripheries—a rotatable wire-covered main cylinder and a rotatable wire-covered doffer. The sliver feed rolls draw sliver in rope form from a source of supply, and deliver the fibres, in sheet form, to the main cylinder. The latter, acting as a transfer medium, conveys the sheet of sliver fibres to the doffer which, in turn, feeds the fibres to the needles of the knitting machine. In order to properly transfer the fibres during their delivery to the needles, the main cylinder is caused to rotate faster than the sliver feed rolls, and the doffer is caused to rotate faster than the main cylinder.

In clothing the doffer, it has been the practice for decades to wrap an elongated, narrow strip of wire-covered card clothing helically about the peripheral surface of the doffer roll. Each end of the helically wound strip is secured to the rim of the doffer roll by fastening means, such as a threaded bolt passing through the rim and being secured thereto by a threaded nut. The helical wrapping of the doffer is time consuming and difficult. No matter how careful the winding, empty spaces or voids often occur in the card clothing because such defects usually are inherent in helical winding. Further, in the helical winding of the elongated strips of card clothing, the spirals often depart from a true helix, the result of which is to create undesirable lines or shadows in the high pile of the fabric being knit. Such lines or shadows are detrimental to the quality of the fabric.

The present invention has been developed with a view to provide an improved means for mounting on a carrier roll a single elongate piece of card clothing which is rectangular as seen in plan and which can be wrapped around the roll e.g. a doffer roll, so as to bring the ends of the piece into abutment with each other and thereby to form a substantially uniform distribution of wire covered clothing on the outer periphery of the roll.

According to one aspect of the invention there is provided an elongate piece of card clothing which is rectangular as seen in plan, and which is capable of being wrapped around a carrier roll having a slot in its outer periphery, said card clothing comprising:

an elongate strip of resilient material having opposed ends which are intended substantially to abut one another in the region of said slot in the carrier roll when the card clothing is wrapped around said carrier roll;

wire carding teeth carried by said strip of resilient material and projecting from one side thereof, so as to be able to form a substantially uniform distribution of carding teeth throughout the outer periphery of the carrier roll; and, an elongate carrier web secured to said elongate strips of resilient material and having opposed ends which each project longitudinally beyond a respective end of the strip so as to form a gripping portion, whereby the two gripping portions can be taken inwardly through said slot in the carrier roll to be engaged by gripping means arranged internally of the carrier roll and operable to apply tension to the web thereby to secure the piece of card clothing in position on the outer periphery of the carrier roll.

Therefore, a piece of card clothing according to the invention can be readily applied to the outer periphery of a carrier roll e.g. a doffer roll, and be securely held in position by taking free ends of the web inwardly through the slot in the carrier roll to be engaged by any suitable gripping means arranged internally of the roll. Jaw type gripping means may be provided associated with each web end, or a common jaw type arrangement may be provided to engage both web ends.

Any existing design of carrier roll can be readily adapted to have the card clothing according to the invention mounted thereon, by forming a slot or groove in its outer periphery, and then by arranging any suitable gripping means internally of the roll, and with access being had to the gripping means conveniently via one of the ends of the roll. For example, the carrier roll may be a hollow cylinder, so that access can readily be had via one of the open ends thereof.

The carrier web may be made of any suitable material of sufficient tensile strength, and which may be secured to the strip of resilient material by any convenient means, such as the use of adhesive. Conveniently, the web and the strip are secured together by driving the carding teeth through the web and through the strip.

The web may be made of textile material, whether woven or non-woven; any other suitable material including plastics sheet, and textile fabric clad or coated with plastics material.

The invention also includes a doffer roll having a slot in its outer periphery, and a piece of card clothing according to said one aspect of the invention mounted thereon with the ends of the web taken through the slot and gripped by gripping means provided internally of the roll and operable to apply tension to the web and thereby to secure the piece of card clothing on the outer periphery of the doffer roll.

By arranging for the web ends to project beyond the ends of the strip, the strip ends can be brought into abutment substantially in line with the slot (with the web ends disappearing into the slot), and therefore substantially the entire outer periphery of the doffer roll can be covered with a substantially uniform distribution of carding teeth, and even in the region of the slot and the abutting strip ends. Also, the securement in position of the piece of card clothing can be easily carried out by operation of the internally mounted gripping means, such operation being carried out via access from one end of the doffer roll.

Embodiments of card clothing according to the invention will now be described in detail, by way of example only, with reference to the accompanying drawing, in which.

Figure 1:
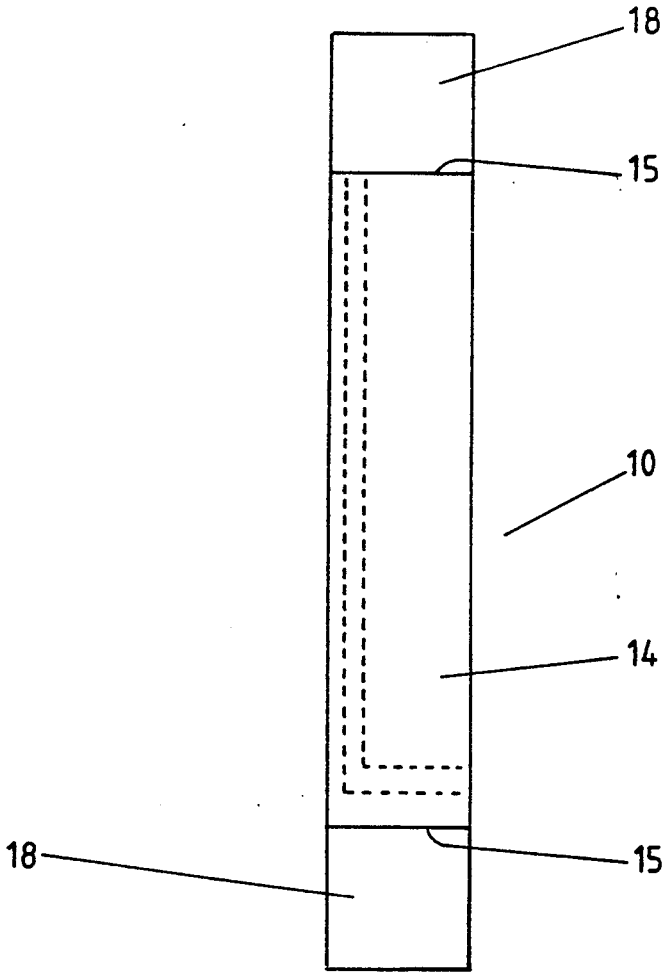
FIG. 1 is a schematic plan view of an elongate piece of card clothing according to the invention.

Referring now to the drawings, an embodiment of elongate piece of card clothing according to the invention is designated generally by reference 10 and is rectangular as seen in plan, as per FIG. 1, and is capable of being wrapped around a carrier roll 11 (FIG. 3) and which is provided with a slot 12 in its outer periphery which has its entrance extending substantially axially i.e. parallel to the axis 13 of the roll 11.

Figure 3:
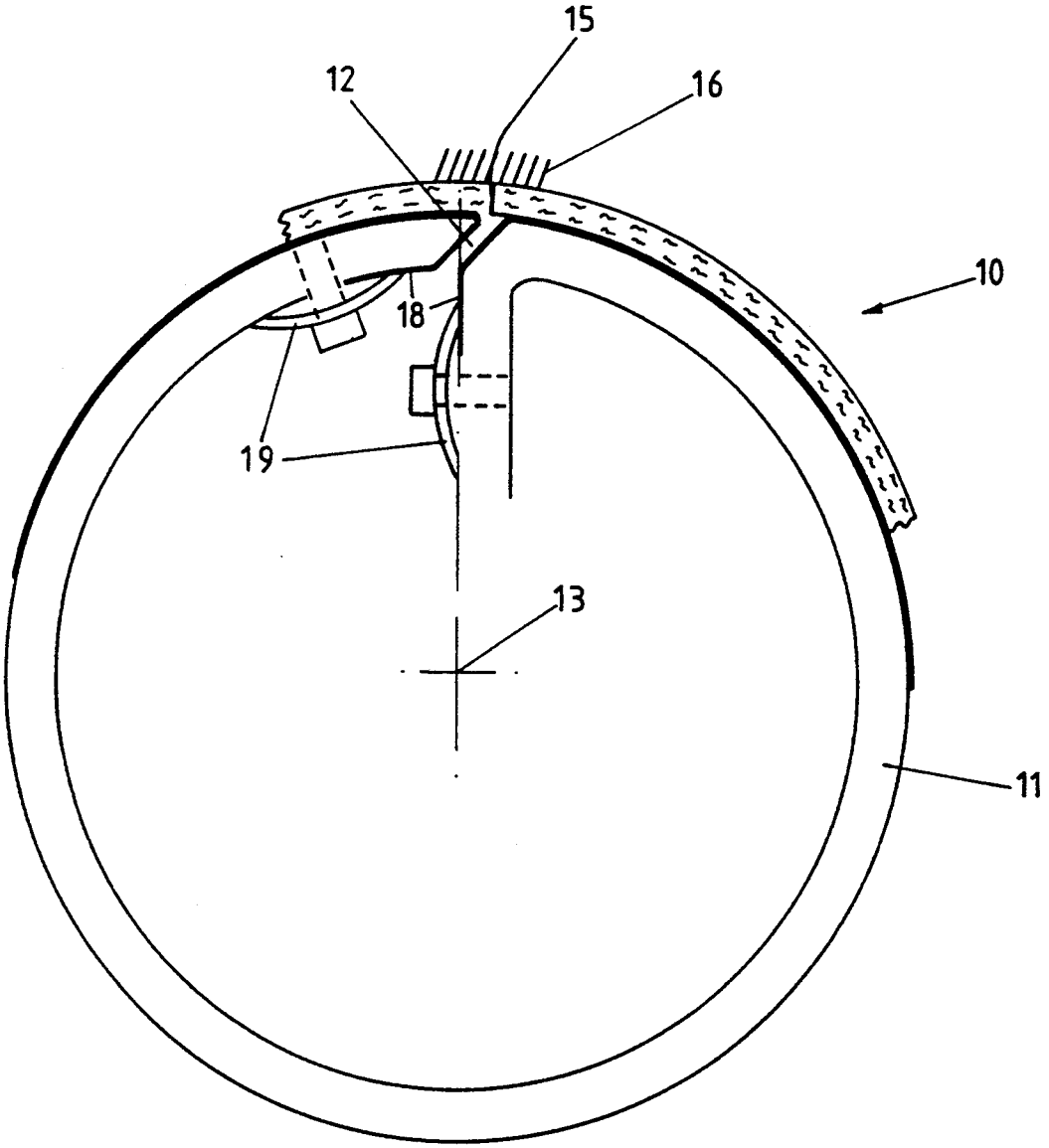
FIG. 3 is an end view of a doffer roll having the piece of card clothing mounted thereon.

It will be noted from FIG. 3 that the roll 11 is formed by a hollow cylinder, and the slot 12 formed in its circumferentially extending wall extends inwardly of the outer surface of the roll, but at an oblique angle.

The card clothing 10 is built up from an elongate strip of resilient material 14, such as rubber, and which has opposed ends 15 which are intended substantially to abut one another and to be joined together by adhesive, as shown in FIG. 3, in the region of the slot 12 in the roll 11, when the card clothing 10 is wrapped around the carrier roll 11.

Wire carding teeth are carried by the strip 14 and project from one side thereof, and these may be mounted in position by any of the conventional techniques employed. As will be evident from FIG. 3, once the card clothing 10 is wrapped around the roll 11, there is a substantially uniform distribution of the carding teeth 16 throughout the outer periphery of the carrier roll 11.

The piece of card clothing also includes an elongate carrier web 17 which is secured to the underside of the strip 14 and has opposed ends 18 which each project longitudinally beyond a respective end 15 of the strip 14 so as to form a gripping portion. Thus, as can be seen clearly from FIG. 3, the gripping portions formed by the projecting ends 18 are taken inwardly through the slot 12 to be engaged by any suitable gripping means arranged internally of the carrier roll 11, and which gripping means can be operated to apply tension to the web 17 thereby to hold the piece of card clothing 10 in position on the outer periphery of the carrier roll.

Any suitable type of gripping means may be provided, including jaw type engagement, to grip the ends 18 and upon operation of the gripping means to apply tension to these ends 18.

Figure 2:
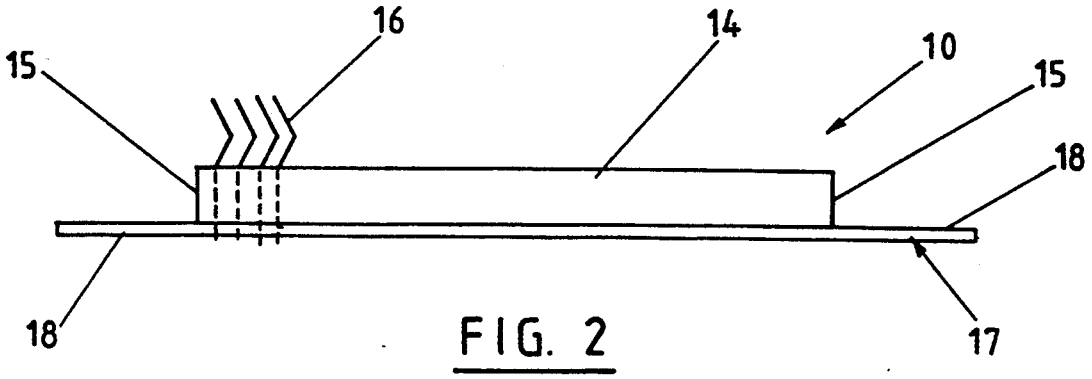
FIG. 2 is a side view of the piece of card clothing shown in FIG. 1.

The web 17 may be made of any suitable material, such as woven or non-woven textile material, a sheet of plastics, or plastics coated or clad textile material. The web 17 may be secured by adhesion to the strip 14, and additionally the entire assembly of the piece of card clothing 10 may be formed into a composite unitary article by driving the card clothing teeth 16 through the web 17 from the underside thereof, and also through the strip 14 so as to project therefrom as shown in FIG. 2.

The carrier roll 11 may be a conventional doffer roll, but modified so as to have the slot 12 provided in its outer periphery, whereby the web ends 18 can be fed downwardly therethrough to be engaged by the gripping means, which are shown schematically by reference 19.

Figure 4:
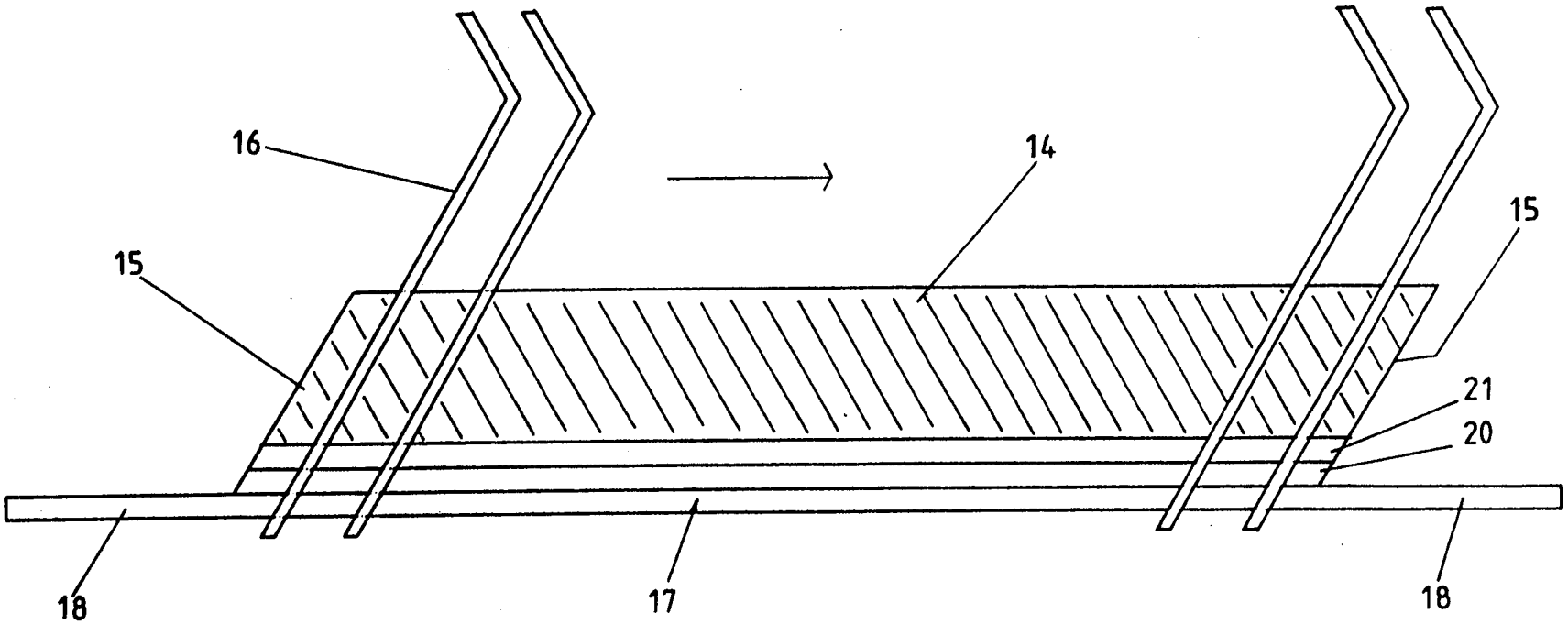
FIG. 4 is a side view of a practical example of a piece of card clothing according to the invention.

FIG. 4 shows a practical example of a piece of card clothing according to the invention, in which the web 17 is formed by a bottom ply of textile material, and intermediate second and third plies 20 and 21 are arranged between the bottom ply and a strip of sponge rubber which forms the strip 14.

Figure 5:
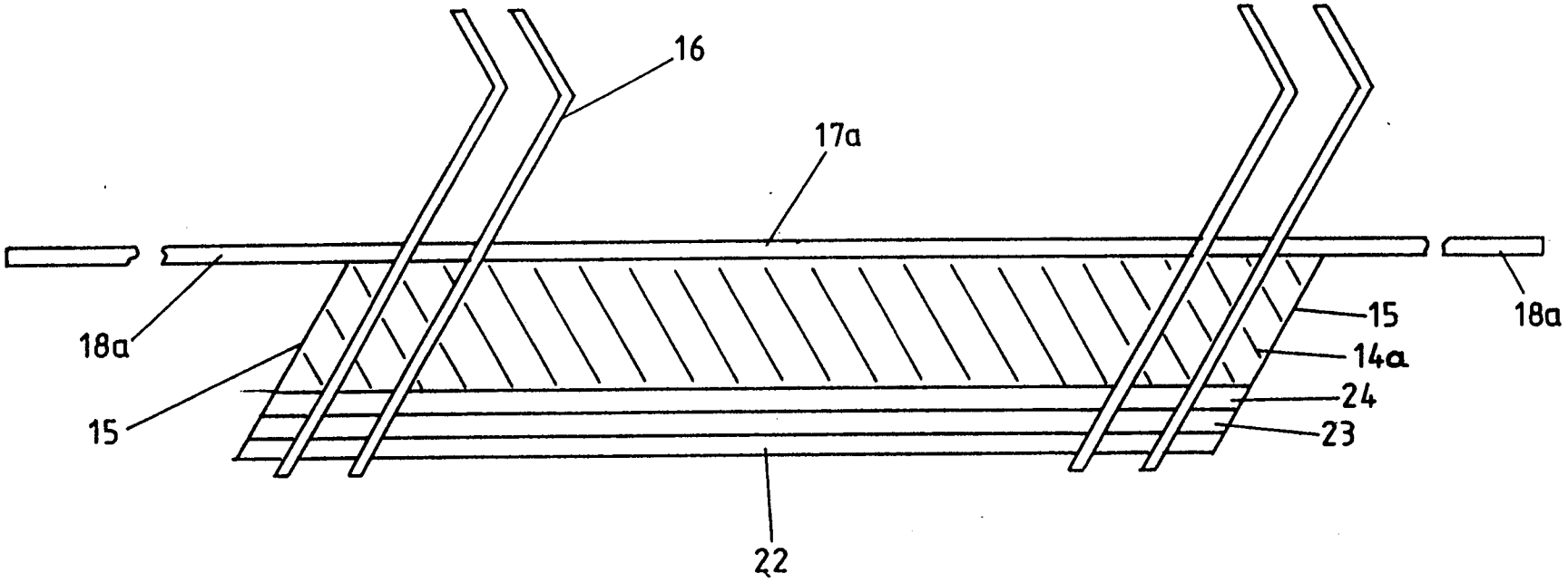
FIG. 5 is a side view of a further practical example of a piece of card clothing according to the invention; and, FIG. 6 is a view, similar to FIG. 3, showing the piece of card clothing of FIG. 5 mounted on a doffer roll.

While FIG. 4 shows an arrangement in which the projecting web ends 18 are provided on the ends of the bottom ply, this is not essential, and the projecting web ends may be provided on the ends of other plies of the piece of card clothing. Thus, as shown in FIG. 5, projecting web ends **18*a* are provided on the upper surface of the piece of card clothing, and not necessarily laminate to the card clothing foundation. In FIG. 5, web 17*a* forms the top ply, and the foundation is formed by sponge rubber strip 14*a*, bottom ply 22, intermediate ply 23 and ply 24 underlying the rubber strip 14*a*. Carding teeth 16 are mounted in the foundation and project upwardly through the web 17*a***.

Figure 6:
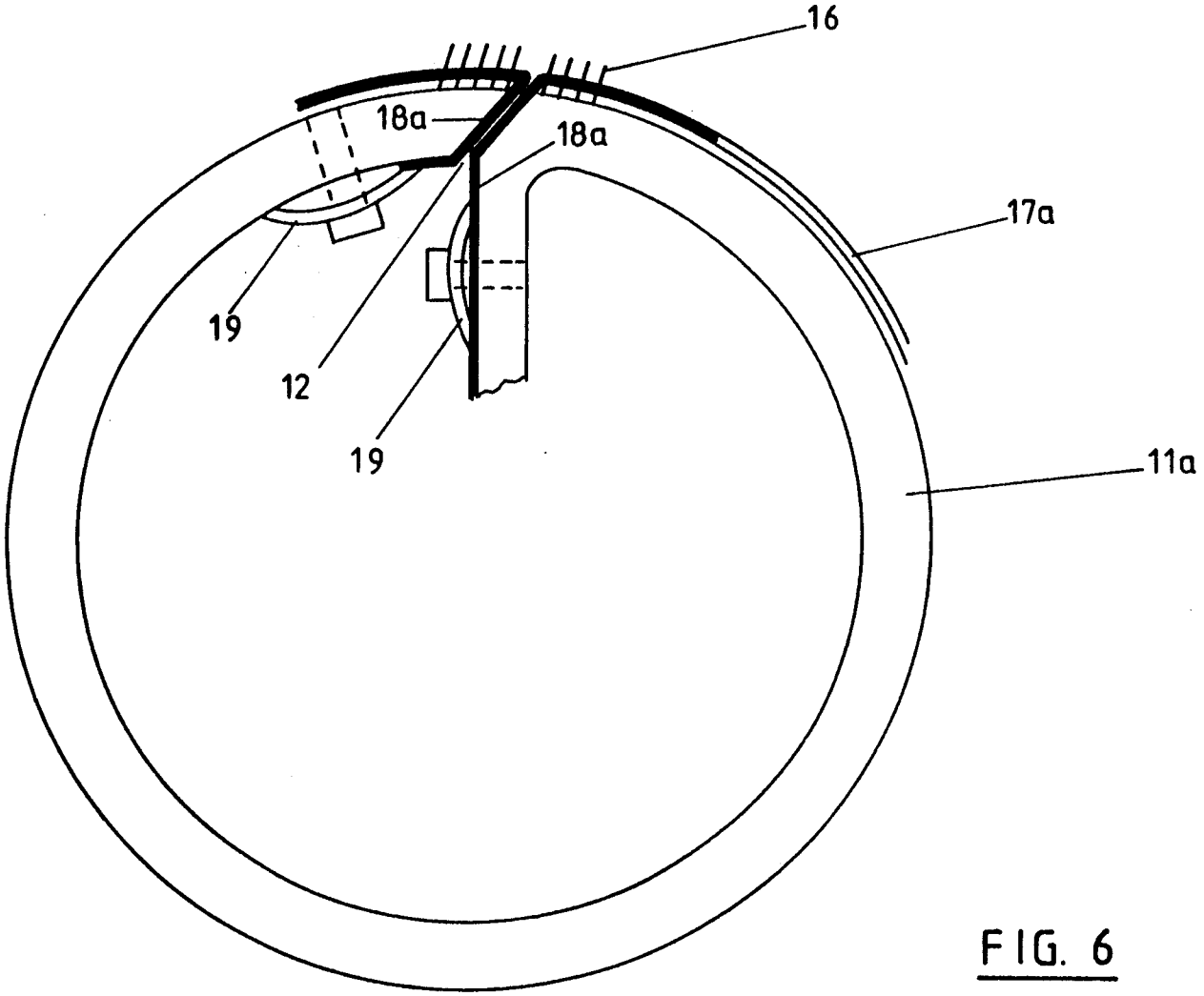

FIG. 6 shows how the modified card clothing can be mounted on a doffer roll **11*a* in generally similar manner to the mounting of the card clothing of FIG. 4 on the doffer roll 11 as shown in FIG. 3**, and corresponding parts are designated by the same reference numerals.

I claim:

1. A roller which is clothed in card clothing, comprising (1) a roller having a slot extending inwardly, in a direction away from its outer surface, and (2) a piece of card clothing wrapped around the said outer surface, the card clothing comprising:

(a) an elongate strip of resilient material having opposed ends which abut one another in the region of the said slot in the outer surface of the roller;

(b) wire carding teeth carried by the strip of resilient material, and projecting from one side thereof so as to form a substantially uniform distribution of carding teeth around the outer periphery of the roller;

(c) an elongate carrier web which is secured to the elongate strip of resilient material, the web having opposed end portions which project beyond respective ends of the strip, and are inserted into the slot in a direction away from the outer surface of the roller; and (d) gripping means arranged inside the roller, to engage the end portions of the carrier web and to retain them in the slot, so as to apply tension to the web and to secure the piece of card clothing in position on the outer surface of the roller.

2. A roller as claimed in claim 1, in which the elongate carrier web is secured to the underside of the strip of resilient material which is remote from the upper side of the strip through which the carding teeth project.

3. A roller as claimed in claim 2, in which the elongate carrier web forms part of the card clothing foundation, and the carding teeth are driven through the carrier web and through the strip of resilient material.

4. A roller as claimed in claim 1, which includes at least one layer of material, between the strip of resilient material and the carrier web.

5. A roller as claimed in claim 1, in which the carrier web overlies the strip of resilient material, and the carding teeth project through the carrier strip.

6. A roller as claimed in claim 1, in which the carrier web is made of textile material.

7. A roller as claimed in claim 1, in which the carrier web is made of a plastics material.

8. A roller as claimed in claim 1, in which the strip of resilient material comprises a sponge rubber strip.

* * * * *

UNITED STATES PATENT AND TRADEMARK OFFICE

CERTIFICATE OF CORRECTION

PATENT NO. : 5,230,124

DATED : 27 July 1993

INVENTOR(S) : Booth

It is certified that error appears in the above-identified patent and that said Letters Patent is hereby corrected as shown below:

On the Title page, item [30], delete "8907969" and insert --8907969.3--.

In Abstract, line 1, at the beginning of the sentence delete "There is disclosed an" and insert --An--.

In Abstract, line 15, delete "by gripping means" and insert --by a gripping device--.

In column 1, on new line 4 after the word "CLOTHING", insert the heading --BACKGROUND OF THE INVENTION--.

In column 1, on new line 48 after the word "fabric.", insert the heading --SUMMARY OF THE INVENTION--.

In column 1, line 59, delete "as seen in plan" and insert --when viewed from above in its unwrapped configuration--.

In column 2, on new line 61 after the word "roll.", insert the heading --BRIEF DESCRIPTION OF THE DRAWINGS--.

In column 3, on new line 9 after the word "roll.", insert the heading --DETAILED DESCRIPTION OF THE INVENTION--.

UNITED STATES PATENT AND TRADEMARK OFFICE

CERTIFICATE OF CORRECTION

PATENT NO. : 5,230,124

DATED : 27 July 1993

INVENTOR(S) : Booth

It is certified that error appears in the above-indentified patent and that said Letters Patent is hereby corrected as shown below:

In column 3, line 12, delete "as seen in plan" and insert --when viewed from above in its unwrapped configuration--.

Signed and Sealed this

Twenty-ninth Day of March, 1994

Bruce Lehman

*Attest:*

BRUCE LEHMAN

*Attesting Officer*

*Commissioner of Patents and Trademarks*